US011518058B2

(12) United States Patent
Groneberg

(10) Patent No.: US 11,518,058 B2
(45) Date of Patent: Dec. 6, 2022

(54) COLLECTING AND DISCHARGING DEVICE FOR THE CUTTING JET OF A LIQUID CUTTING SYSTEM

(71) Applicant: Nienstedt GmbH, Haltern am See (DE)

(72) Inventor: Jan Groneberg, Berlin (DE)

(73) Assignee: Nienstedt GmbH, Haltern am See (DE)

( * ) Notice: Subject to any disclaimer, the term of this patent is extended or adjusted under 35 U.S.C. 154(b) by 495 days.

(21) Appl. No.: 16/714,844

(22) Filed: Dec. 16, 2019

(65) Prior Publication Data

US 2021/0178625 A1 Jun. 17, 2021

(51) Int. Cl.

| | |
|---|---|
| ***B26F 3/00*** | (2006.01) |
| ***B24C 1/04*** | (2006.01) |
| *B24C 5/04* | (2006.01) |

(52) U.S. Cl.

CPC ..... *B26F 3/008* (2013.01); *B24C 1/045* (2013.01); *B24C 5/04* (2013.01)

(58) Field of Classification Search

CPC ..... B26F 3/008; B24C 5/04

See application file for complete search history.

(56) References Cited

U.S. PATENT DOCUMENTS 4,501,182 A * 2/1985 Jardat ..... B26D 7/20 83/177
4,534,427 A * 8/1985 Wang ..... B24C 1/04 175/70
4,854,090 A * 8/1989 Heron ..... B24C 1/045 451/99
5,567,376 A * 10/1996 Turi ..... D04H 1/495 425/290
5,782,673 A * 7/1998 Warehime ..... B24C 5/02 451/36
6,299,510 B1 * 10/2001 Massenburg ..... B24C 9/006 451/39
2005/0145166 A1 * 7/2005 Seo ..... H01L 21/67092 117/200
2005/0202764 A1 * 9/2005 Tateiwa ..... B24C 9/00 451/87

(Continued)

FOREIGN PATENT DOCUMENTS

DE 3518166 C1 11/1986
DE 29920718 U1 3/2000

(Continued)

*Primary Examiner* — Omar Flores Sanchez
(74) *Attorney, Agent, or Firm* — Bejin Bieneman PLC

(57) ABSTRACT

A collecting and discharge device for the cutting jet of a fluid jet cutting system, comprises a cutting jet collector and a discharge for the cutting medium flow collected the cutting jet collector. The cutting jet collector has a jet discharge channel with an inlet region for introducing the cutting jet. The cutting jet is in flow connection with an outlet region via an discharge line. The jet discharge channel leads into a suction chamber disposed underneath the outlet region, said suction chamber having an enlarged cross section in the outlet region compared with the cross section of the jet discharge channel. The suction chamber additionally connects the jet discharge channel with the discharge line and with a suction channel as well as being otherwise closed. The suction channel provides suction at a suction opening forming a suction mouth in a suction region surrounding the inlet region of the jet discharge channel.

15 Claims, 2 Drawing Sheets

(56) References Cited

U.S. PATENT DOCUMENTS

| | | | | |
|---|---|---|---|---|
| 2013/0306748 | A1* | 11/2013 | Hashish | B26F 3/008 239/11 |
| 2021/0107114 | A1* | 4/2021 | Linde | F16K 5/06 |

FOREIGN PATENT DOCUMENTS

| | | | |
|---|---|---|---|
| DE | 10051942 | B4 | 12/2004 |
| DE | 102017124738 | A1 | 4/2019 |
| EP | 0244966 | B1 | 3/1991 |
| EP | 3473393 | A1 | 4/2019 |
| WO | 2017071697 | A1 | 5/2017 |

* cited by examiner

COLLECTING AND DISCHARGING DEVICE FOR THE CUTTING JET OF A LIQUID CUTTING SYSTEM

CROSS-REFERENCE TO RELATED APPLICATIONS

This application is related to European Patent Application No. EP3473393 A1, filed Oct. 19, 2018, and German Patent Application No. DE102017124738 filed on Oct. 23, 2017.

BACKGROUND

Collection and discharge devices for the cutting jet of a liquid cutting system or plant of this type as well as an associated liquid cutting system are known from DE 35 18 166 C1.

The liquid cutting system described in connection with the functional description of the known collecting and discharging device has a workpiece support over which the workpieces are guided through the cutting jet, making a cut. The cutting jet emerging from the underside of the workpiece is collected by the collection and discharge device below the workpiece support, expanded and discharged for processing. The cutting jet comprises the actual liquid cutting medium on the one hand and any gaseous components or solid particles originating from the workpiece on the other.

All types of workpieces can be cut with the known liquid cutting systems. Cutting by means of a liquid jet has the advantage that virtually no forces occur in the feed direction, precise cutting geometries can be realized and comparatively high feed speeds can be achieved. A possible application for such liquid cutting systems, besides cutting plastic, foam or metal, is cutting food.

Cutting food is often not easy with conventional cutting devices, such as ultrasonic knives or saws. Non-frozen foods are usually soft, which leads to the risk of solid components within the food getting caught on the cutting tools and smearing the cut.

For example, when cutting pieces of cake, a harder piece of chocolate or a fruit ingredient can make the cutting edge so irregular that the product no longer meets the quality requirements. Furthermore, a knife moving through a cake, for example, can smear fruit pulp along the dividing plane, resulting in an unsightly side surface. For these reasons, cutting by means of a liquid jet is a suitable method.

Existing liquid cutting systems have collection and discharge devices for the escaping cutting jet. Here it is known that this cutting jet is processed using various aids, for example to reduce the energy of the jet, so that the collection and discharge device is not exposed to excessive wear.

A disadvantage of the collection and discharge devices used up to now is that below the workpiece, when the cutting jet emerges from the cut, turbulence can occur, which can lead on the one hand to parts of the fluid used for cutting or to particles separated from the workpiece being released into the environment during cutting. Such particles can also settle on the underside of the workpiece.

While contamination of the underside of the workpiece is often a nuisance when cutting industrially used intermediate products made of plastic or metal, as these products have to be cleaned again afterwards, cutting foams or even food can cause major problems. Here, for example, contamination of the product must be avoided as it cannot be reversed.

For example, the soaking of an porous foam below the cutting line is usually undesirable. In connection with food, moisture penetration is also undesirable. Furthermore, particles can settle in the region of the cutting edges, which impair the visual appearance of the cutting line or the food itself. In addition to the particles removed by the cutting jet as a result of the cutting process, these can also include components in the form of icing sugar or other components that can be swirled up as a result of the dynamic movements that occur and subsequently settle uncontrollably in undesirable places.

The workpiece support can also be contaminated by such effects, which in turn can indirectly lead to contamination of the workpiece itself. In connection with food, there is the further problem that residues of the previously cut food can be deposited on the workpiece support, which then has to be cleaned to avoid contamination of the following food. Especially in connection with egg-containing, poultry-containing or fish-containing food, this can lead to an increased expense.

From DE 100 51 942 B4 a liquid cutting system is known which has a jet outlet below the workpiece support. This jet discharge is surrounded by a ring-shaped channel in which an increased liquid pressure provided by an external supply line is applied, whereby liquid is introduced into the jet discharge from this channel in the upper region. This creates a flow directed in the direction of the jet entry within the jet outlet into which the cutting jet enters, in order to slow down and expand the cutting jet in the liquid flow in this way.

This device suffers from the disadvantage that contamination can occur below the workpiece support and effective extraction of residual cutting material is not possible. Furthermore, due to the water-filled inlet channel for the cutting jet, there is a risk that parts of the cutting jet or the water in the inlet channel may splash back.

From the WO 2017/071697 A1 a liquid cutting system for food is known, which has a lower jet outlet and an annular channel arranged around it, whereby suspended matter is extracted via the annular channel. This is achieved by connecting the duct to an external vacuum source, which in turn increases the effort required.

The known collecting and discharge devices for the cutting jet of a liquid cutting system have the disadvantage that cutting media parts or entrained particles can contaminate the workpiece or the environment.

SUMMARY

The present disclosure relates to collecting and discharging device for the cutting jet of a liquid cutting installation having a cutting jet collector and a discharge for the media flow collected via the cutting jet collector, wherein the cutting jet collector has a jet discharge channel with an inlet region for introducing the cutting jet which is in flow connection with an outlet region with a discharge line. Furthermore, the disclosure relates to a liquid cutting system or plant with such a collecting and discharging device.

Advantageously, the presently disclosed cutting jet can be reliably discharged in a structurally simple manner, whereby the discharged material can be fed to a preparation plant in a favorable and simple manner. A liquid cutting system can include a collecting and discharging device.

With regard to the collection and discharge device, this problem is solved according to the disclosure by the fact that the cutting jet collector is designed in such a way that the jet discharge channel exits into a suction chamber arranged below the outlet region, which has a cross-section which is enlarged in comparison with the cross-section of the jet discharge channel in the outlet region and, in addition to the jet discharge channel, is fluidically connected to the discharge line and to a suction channel and is otherwise closed, the suction channel extending in a suction region surrounding the inlet region of the jet discharge channel in order to form a suction function to a suction opening forming a suction mouth.

The liquid jet is directed at the workpiece under high pressure and exits the bottom of the workpiece with a slight expansion. The invention can optionally be used in conjunction with liquid cutting systems in which either the workpiece is moved relative to the cutting jet or alternatively the cutting jet is moved relative to the workpiece. A combination of both movements is also possible with the liquid cutting systems according to this disclosure. A goal is a good collection of all components of the cutting jet as well as their removal and disposal or reconditioning.

According to one aspect, a cutting jet collector is used which, essentially in the manner of a venturi nozzle or a jet pump, is able to provide a suction function which sucks off the portions of the cutting jet which do not find the direct path into the inlet region of the suction channel or which, due to fluidic dynamics, leave this inlet region again, and can feed them to the material flowing off in the discharge pipe.

The suction function mentioned above can be realized by the flow velocity of the cutting jet. For this purpose, the entry of the cutting jet into a suction chamber downstream of the jet discharge channel, which can also be integrated into the jet discharge channel, is used to generate a suction negative pressure.

In the case of a preferred design of the disclosure, the jet discharge channel is arranged in the central region of the cutting jet collector. A possible configuration, for example, has an upper, funnel-shaped inlet region, a straight channel course and an inlet to the suction chamber arranged below the suction channel. The cutting media stream entering the suction channel from above then enters the suction chamber in the form of a jet, resulting in a vacuum in the suction chamber around the free jet of the cutting media stream.

The suction chamber, in turn, is connected via the suction channel to a suction region below the processing point where the cutting jet passes through the workpiece. For example, it can be arranged above the inlet region for the cutting jet into the jet discharge channel, but it can also be arranged next to the inlet region or around the inlet region or further down. In one of these possible configurations, for example, a small gap is provided between the underside of the workpiece support and the upper side of the cutting jet collector, which forms the suction region. This space is sucked off by a suction mouth in flow connection with the suction channel.

It is preferable, since the parts or particles which separate from the cutting jet can move away in all directions from the jet propagation direction of the cutting jet, that the suction mouth is either ring-shaped or two or more individual suction ducts are provided which are distributed over the circumference of the inlet region of the jet discharge duct on its sides. The cross-sections of the suction ducts can be round or oval or in the form of circular ring segments.

With an alternative configuration, a nozzle can also be integrated directly into the jet discharge channel instead of a tubular jet discharge channel with a constant cross-section. For this purpose, the through-opening in an upper part of the nozzle, which passes through the cutting jet collector, has this nozzle, which, starting from a first cross-section, has a second cross-section, which is reduced in comparison with the first cross-section in the further jet path. In the aftermath of this second cross-section, the diameter then increases again, whereby the enlarged region can then form the suction chamber.

Here, the suction channels or the suction channel are directly connected to the hole in the region of the third diameter with an enlarged cross-section. Of course, the negative pressure resulting in this region can also be made available via other lines of a separate suction chamber into which the suction ducts or the suction duct then flow.

The disclosure is based on the fact that the flow dynamics are used to generate a negative pressure or to amplify a provided negative pressure. In principle, the disclosed subject matter can be used in conjunction with an explicit extraction system to either increase the negative pressure used for extraction or to extend the range in which an extraction effect is effective. Thus the performance of a suction pump can be reduced by supporting it, thus saving energy.

In the case of a design, the flow dynamics alone can provide the vacuum required for suction without additional devices that generate negative pressure. This negative pressure is then used to suck off fluid components, particles or gases via one or more suction mouths located next to or around the inlet region of the cutting jet into the jet discharge channel. These undesirable components cannot deposit on the workpiece or contaminate the environment, but are sucked off and then can be returned to the outflowing cutting media stream in the discharge line.

In addition to the actual processing station for the workpiece, in which a moving or stationary cutting jet emerges from a cutting jet nozzle and cuts the workpiece moved relative to the cutting jet nozzle, the liquid cutting system in accordance with the disclosure has the collection and discharge device described above. Furthermore, a preparation or at least a separation station for the individual components of the media contained in the cutting jet can be provided.

The way in which the workpiece is cut by the liquid jet or the way in which the workpiece support is formed is not crucial. The disclosed subject matter can basically be used with any suitable design, and/or can in principle be used with all types of workpieces and cutting media, in particular water, oil or similar liquids.

The discharge pipe feeds the material of the cutting jet collected by the collection and discharge device to a preparation unit or a separating device. This comprises a separator which is able to separate the individual components of the media flow from each other.

In addition to the fluid of the cutting medium, the media flow can also include entrained particles of the workpiece itself, whether they have been detached by the cutting process or fall off the workpiece during machining, and gaseous components. Gaseous components are usually air components that are entrained by the cutting jet due to the flow dynamics, but other components can also occur here, for example in the form of protective gas.

First, the gaseous components are separated from the heavier particles and fluid components in a separator. This separator can be a cyclone separator which separates the gases from the heavier particles by utilizing the different inertial forces in a rotating chamber or in a rotating media stream. The gas components are then sucked off via a gas outlet, where they can also be filtered to filter out the last solid components or nebulized liquid components. Electrostatic filters can also be used.

The heavier or larger particles can be separated either by the cyclone separator, an additional second cyclone separator or by filter media or sieves. Ultimately, this depends on the application, which determines which types and seize of particles are present in the cutting media stream.

Once the solids have been separated from the liquid components, the liquid can be discharged via a liquid discharge system or returned to the liquid supply of the liquid cutting system, if necessary also under further filtration. If necessary, the liquid can be further processed or disinfected, for example either by heating or by other known measures.

Insofar as the term "approximately" is used in the instant disclosure, this term specifies a tolerance range, which the person of skill in the art in the instant field considers to be common. In particular, a tolerance range of up to plus or minus 20 percent, which could be limited to up to plus or minus 10 percent, is to be understood by the term "approximately".

Further areas of applicability will become apparent from the description provided herein. It should be understood that the description and specific examples are intended for purposes of illustration only and are not intended to limit the scope of the present disclosure. Further advantages become apparent from the description below of preferred embodiment with reference to the drawings.

SUMMARY OF THE DRAWINGS

The drawings described herein are for illustration purposes only and are not intended to limit the scope of the present disclosure in any way.

In the drawings.

DETAILED DESCRIPTION

Figure 1:
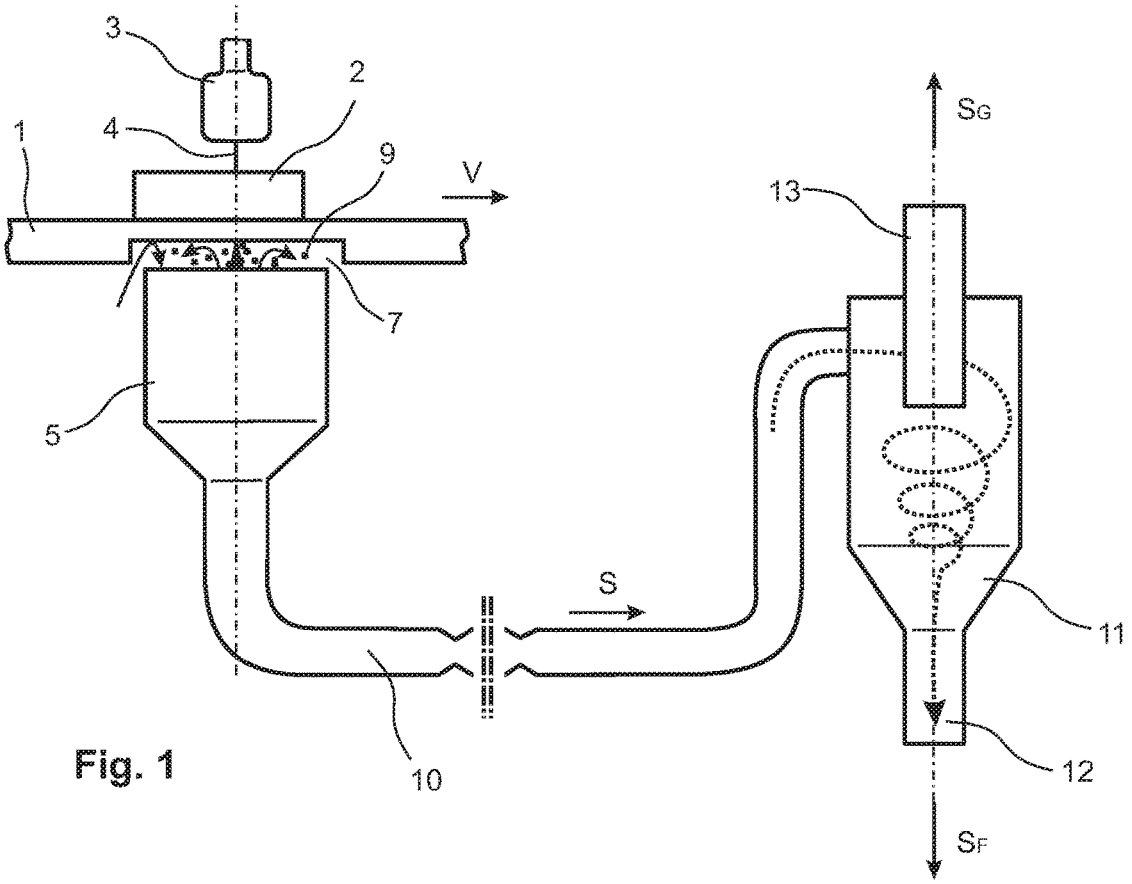
FIG. 1 shows an example cutting system.

FIG. 1 shows a schematic representation of a liquid cutting system including a cutting jet collector 5. The cutting jet collector 5 is provided below the workpiece support 1 on which the workpiece 2 rests. Here the workpiece support 1 is designed to be movable so that the workpiece 2 passes the cutting jet 4 emerging from the cutting jet nozzle 3, which makes a cut in the workpiece 2.

The cutting jet 4 (a jet for cutting media) passes through a gap (not visible here) in the workpiece support 1 and into the cutting jet collector 5. So that the gap does not have to extend through the entire length of the workpiece support 1, the workpiece 2 can be transported along the upper side of the workpiece support 1 via a workpiece carrier. Due to the dynamics of the high-pressure cutting used here with pressures of the cutting medium of up to 6000 bar, the cutting jet exits below the cut at high speed. This cutting jet includes the actual cutting jet 4, as well as particles 9 coming from workpiece 2 and entrained air particles.

The cutting jet enters the inlet region of the jet discharge channel 6 (see FIGS. 2-6; not shown in FIG. 1) in the cutting jet collector 5. After passing the workpiece 2, the cutting jet 4 widens slightly. As a result of this jet expansion, the reflections from the jet discharge channel 6, and other effects, it can also happen that particles 9 are thrown out of the entrance region again in the opposite or a lateral direction. Due to this effect and other scattering effects, the region below the workpiece support 1 can have both atomized liquid components, workpiece particles 9 or liquid droplets which, depending on the design of the workpiece support 1, can either deposit on this or on the workpiece 2 or escape from the liquid cutting system.

Figure 2:
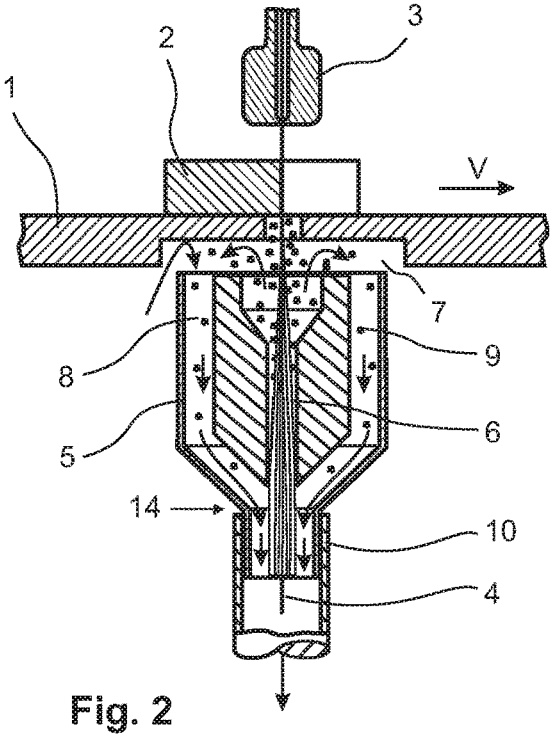
FIG. 2 shows the region of a cutting media outlet in a sectional view.

In order to be able to feed these undesirable components now also to the discharge line 10, which connects the collection and discharge device with the further preparation for the final cutting medium, suction is provided according to this disclosure, which provides a suction region 7 in the area between the workpiece support 1 and the collection and discharge device. This function is best seen in FIG. 2, which shows the collection and discharge device in a schematic cross-sectional view.

The cutting jet 4 emerging from the cutting jet nozzle 3 cuts the workpiece 2 and enters the collecting and discharge device through the opening in the workpiece support 1. Here a jet discharge channel 6 is provided in the middle. In the upper region, this jet discharge channel 6 is extended like a funnel in order to form an effective collector for the cutting jet 4.

In the lower region, the jet discharge channel 6 emerges from the core of the collection and discharge device, with a space being provided below this lower region into which the cutting jet then flows as a free jet. The diameter of this space, which serves as a suction chamber 14 (see FIGS. 2 and 3), is larger than that of the outlet opening of the jet discharge channel 6; in the design example shown, the diameter is approximately twice that of the jet discharge channel 6.

Due to the cutting jet emerging freely at high speed from the jet discharge channel 6, a vacuum is created around this jet according to the principle of the jet pump. A suction channel 8 is arranged in a ring around the core of the collection and discharge device, so that the negative pressure can suck off the region above the collection and discharge device, so that the region can function as suction region 7. Particles 9 and ambient air are thus sucked into the suction channel 8 and then fed together with the cutting jet to the discharge line 10 (see FIG. 1).

The shown shape of the suction channel 8 is only an example, here several suction channels 8 distributed over the circumference can be provided instead of a ring-shaped channel. An advantage is that the cutting jet emerging from the jet discharge channel 6 itself generates the negative pressure which turns the region above the collecting and discharge device into the suction region 7.

As can be seen from FIG. 1, the media stream collected in this way is fed to a schematically depicted processing unit. This includes of a separator 11 which separates the gaseous components from the heavier solid or liquid components. This separator 11 can comprise a cyclone separator which, using centrifugal forces, is able to separate gaseous components from the heavier remaining components, which are then discharged into the environment by a gas discharge 13 into a suction direction of the gas SG, if it is environmentally harmless. This separation via the cyclone separator is already known, for example, from bag-less vacuum cleaners.

The remaining components are then discharged by the liquid discharge 12 in the discharge direction of the liquid SF and, if necessary, separated from each other by further cyclone separators or filter media and disposed of or reused in the case of the fluid.

Figure 3:
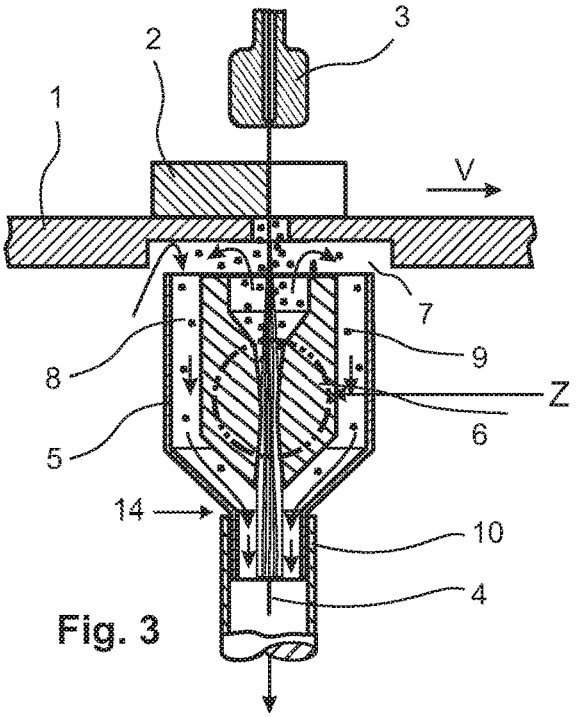
FIG. 3 shows an alternative example of the fluid jet cutting system.

FIG. 3 shows an alternative embodiment of the fluid jet cutting system shown in FIG. 2. With the exception of the jet discharge channel 6, this variant is identical to the version shown in FIG. 2. Here, however, the jet discharge channel 6 is nozzle-shaped.

Figure 4:
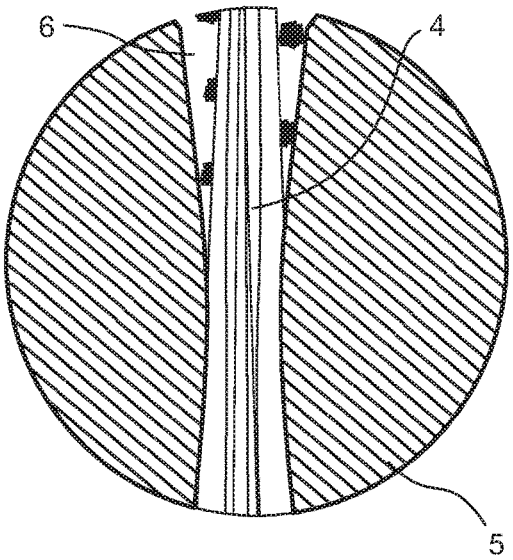
FIG. 4 shows the nozzle-shaped design of a jet discharge channel of FIG. 3 in an enlarged representation.

FIG. 4 shows the nozzle-shaped design of the jet discharge channel 6 (detail "Z" in FIG. 3) in enlarged representation. The nozzle-side design results in a flow acceleration of the cutting jet 4, which improves the effect of the suction channel 8 due to the more favorable pressure drop.

Figure 5:
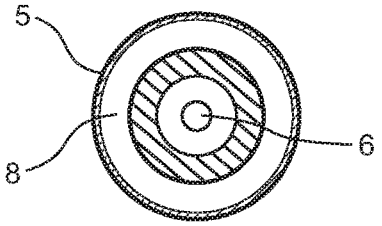
FIG. 5 shows the region of the jet discharge channel in a top view.

FIG. 5 shows the region of the jet discharge channel 6 in a top view, i.e., from the point of view of the workpiece support 1 in a sectional view. The ring-shaped course of the suction channel 8 around the jet discharge channel 6 can be seen here.

Figure 6:
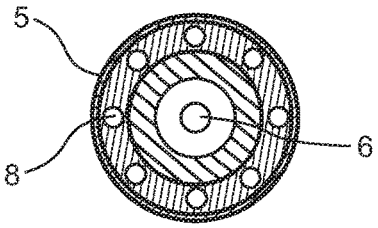
FIG. 6 shows a variant of a suction channel.

FIG. 6 shows a variant of the suction channel 8 in which the suction channel 8 does not run as a ring around the jet discharge channel 6, but is formed by several individual suction channels 8.

Figure 7:
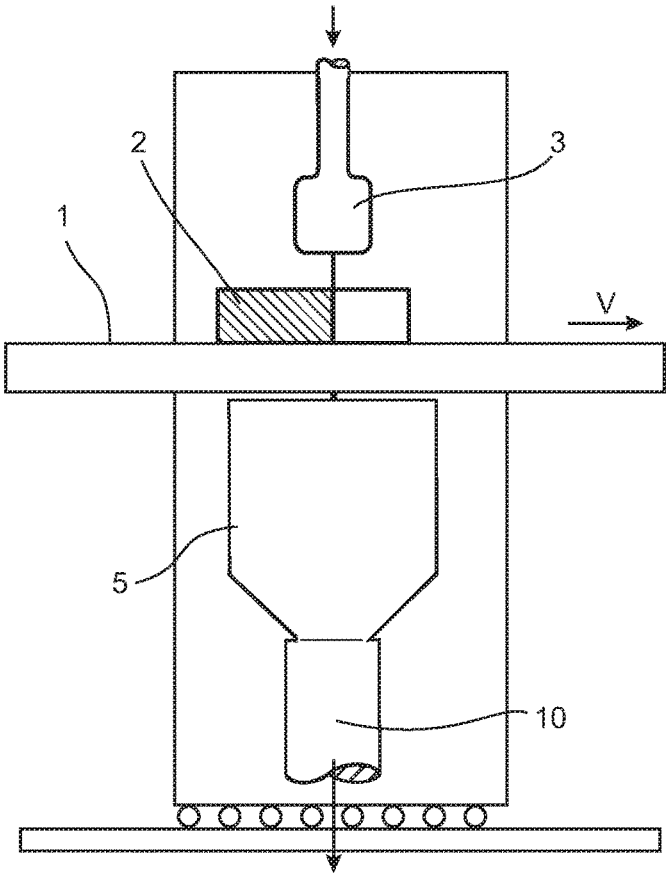
FIG. 7 schematically shows an example cutting system.

FIG. 7 schematically shows a cutting system based on the disclosure, in which both the cutting jet nozzle 3 and the suction device arranged below the workpiece support 1 with the cutting jet collector 5 and the discharge line 10 are attached to a movable carrier. The carrier is mounted on schematically depicted rollers and can thus be moved along the fixed workpiece support 1. Alternatively, the carrier can of course also be fixed and the workpiece support 1 can be moved along the carrier.

The present disclosure is merely exemplary in nature and variations that do not depart from the gist of the present disclosure are intended to be within the scope of the present invention. Such variations are not to be regarded as a departure from the spirit and scope of the present invention.

What is claimed is:

1. A collecting and discharge device for the cutting jet of a fluid jet cutting system, comprising:

a cutting jet collector; and a cutting jet for cutting medium flow collected in the cutting jet collector;

wherein the cutting jet collector has a jet discharge channel with an inlet region for introducing the cutting jet;

wherein the cutting jet is in flow connection with an outlet region via a discharge line;

wherein the jet discharge channel leads into a suction chamber disposed underneath the outlet region, said suction chamber having an enlarged cross section in the outlet region compared with the cross section of the jet discharge channel;

wherein the suction chamber additionally connects the jet discharge channel with the discharge line and with a suction channel as well as being otherwise closed;

wherein the suction channel provides suction at a suction opening forming a suction mouth in a suction region surrounding the inlet region of the jet discharge channel.

2. The collecting and discharge device of claim 1, wherein the suction chamber is formed around an opening of the discharge line.

3. The collecting and discharge device of claim 1, wherein the jet discharge channel comprises one or more nozzle-shaped cross sectional sections with a narrowing cross section to which a widening cross section is connected, viewed in the direction of flow.

4. The collecting and discharge device of claim 3, wherein the suction channel is in flow connection with the jet discharge channel in the region where the cross section widens following the narrowing of the cross section in the direction of flow.

5. The collecting and discharge device of claim 1, wherein the inlet region of the jet discharge channel is funnel-shaped.

6. The collecting and discharge device of claim 1, wherein the suction channel annularly surrounds a core of the collecting and discharge device except for the jet discharge channel.

7. The collecting and discharge device of claim 1, wherein two or more suction channels are provided.

8. The collecting and discharge device of claim 1, wherein the cutting jet, including the cutting medium and gas or workpiece particles escaping as a free jet from the jet discharge channel and forming a suction region surrounding the jet, enters the suction chamber.

9. A fluid jet cutting system with a workpiece support for a workpiece that is cut by a cutting jet, comprising:

a collecting and discharge device for the cutting jet;

wherein the cutting jet, movable relative to the workpiece, is provided from a cutting jet nozzle as a fluid jet, and, cutting the workpiece, enters a collecting and discharge device disposed below the workpiece, to collect particles of the workpiece and particles escaping from the fluid of the cutting jet as well as gaseous amounts forming the cutting jet, and wherein the collecting and discharge device is connected to a discharge of the cutting jet by a discharge line;

wherein the collecting and discharge device for the cutting jet comprises:

a cutting jet collector; and a discharge for cutting medium flow collected by means of the cutting jet collector;

wherein the cutting jet collector includes a jet discharge channel with an inlet region for introducing the cutting jet, which is in flow connection with an outlet region with the discharge line;

wherein the jet discharge channel leads into a suction chamber disposed underneath the outlet region, said suction chamber having an enlarged cross section in the outlet region compared with the cross section of the jet discharge channel, and wherein the suction chamber additionally connects the jet discharge channel with the outflow line and with a suction channel as well as being otherwise closed;

wherein the suction channel provides suction at a suction opening forming a suction mouth in a suction region surrounding the inlet region of the jet discharge channel.

10. The fluid jet cutting system of claim 9, wherein the diameter of the jet discharge channel is at least one of 1.5 to 10 times greater than the internal diameter of the cutting jet nozzle or dimensioned such that decelerated medium of the cutting jet with no amounts of air may drain off, completely filling the jet discharge channel, and thereby may flow away continuously without blockage.

11. The fluid jet cutting system according to claim 9, wherein the cutting jet nozzle and the collecting and discharge device for the cutting jet are configured to work with one another in a feed direction.

12. The fluid jet cutting system according to claim 9, wherein the outflow line is formed at least partially by a flexible hose line.

13. The fluid jet cutting system of claim 9, wherein the cutting jet is formed by a separator to separate the fluid, gaseous and solid particles of the cutting medium flow.

14. The fluid jet cutting system of claim 9, wherein the separator comprises a cyclone separator.

15. The fluid jet cutting system of claim 14, wherein the separator is configured, to separate gaseous components of the cutting medium flow from remaining components, wherein the separator is configured to deliver, via a vacuum hose serving as a gas discharge, the separated gaseous components.

* * * * *